US005412453A

United States Patent [19]

Matsuo

[11] Patent Number: 5,412,453

[45] Date of Patent: May 2, 1995

[54] TEMPERATURE CONTROLLER

[75] Inventor: Tetsushi Matsuo, Tokyo, Japan

[73] Assignee: Kabushiki Kaisha Toshiba, Kawasaki, Japan

[21] Appl. No.: 309,494

[22] Filed: Sep. 23, 1994

Related U.S. Application Data

[63] Continuation of Ser. No. 815,787, Jan. 2, 1992, abandoned.

[30] Foreign Application Priority Data

Jan. 11, 1991 [JP] Japan ..... 3-002261

[51] Int. Cl.[6] ..... G03G 15/20

[52] U.S. Cl. ..... 355/208; 355/285

[58] Field of Search ..... 355/285, 282, 208; 219/216, 469

[56] References Cited

U.S. PATENT DOCUMENTS 4,415,800 11/1983 Dodge et al. ..... 219/497
4,480,908 11/1984 Anzai et al. ..... 355/285
4,493,984 1/1985 Yamauchi ..... 219/497 X
4,868,368 9/1989 Araki ..... 219/216
4,905,051 2/1990 Satoh et al. ..... 355/282 X
5,109,255 4/1992 Nishikawa et al. ..... 355/285
5,179,263 1/1993 Koh et al. ..... 219/216
5,216,225 6/1993 Muto et al. ..... 219/216

*Primary Examiner*—A. T. Grimley
*Assistant Examiner*—Nestor R. Ramirez
*Attorney, Agent, or Firm*—Finnegan, Henderson, Farabow, Garrett & Dunner

[57] ABSTRACT

A temperature controller forcibly stops an operation of a heating member when a detected temperature detected by a temperature sensor reaches a predetermined heating interruption temperature in an initial temperature rising state. Thereafter, when the detected temperature reaches a standby control temperature, or when a predetermined heating interruption period elapses from when the operation of the heating member is forcibly stopped, the drive operation of the heating member is controlled based on the detected temperature and the standby control temperature from when the detected temperature reaches the predetermined standby control temperature lower than a target temperature until a predetermined standby control period elapses.

19 Claims, 6 Drawing Sheets

TEMPERATURE CONTROLLER

This application is a continuation of application Ser. No. 07/815,787, filed Jan. 2, 1992, now abandoned.

BACKGROUND OF THE INVENTION

1. Field of the Invention

The present invention relates to a temperature controller for detecting the temperature of an object to be heated, and controlling a drive operation of a heating member for heating the object to be heated according to the detected temperature.

2. Description of the Related Art

In an electrophotographic recording apparatus such as a laser printer, a heat roll is provided in a fixing device for fixing, on a paper sheet, a toner image transferred from a developer thereto. The heat roll is heated by a heater and melts a toner attached to a paper sheet. When the paper sheet with the melt toner is clamped between the heat roll and a pressure roller, the melt toner is fixed onto the paper sheet under pressure.

In a heat roll of this type, the temperature of the roll must be kept constant so as to obtain a stable image and to assure safety. For this purpose, the temperature control of the heat roll is performed, and is often realized by thermal feedback control.

According to a conventional heat fixing device, a heater arranged in a heat roll is heated by energization from a power supply through a switch and a temperature over-rise prevention device such as a fuse or a thermostat. In this case, in a temperature controller used in the heat fixing device, a temperature sensor detects the temperature of the heat roll, and supplies a voltage according to the detected temperature to a comparator. The comparator compares the voltage corresponding to the detected temperature with a reference voltage corresponding to a target temperature, thereby ON/OFF-controlling the switch.

With this control system, when the output voltage from the temperature sensor is smaller than the reference voltage, i.e., when the temperature of the heat roll is lower than the target temperature, the switch is turned on, and the heater is heated. In contrast to this, when the output voltage from the temperature sensor is larger than the reference voltage, i.e., when the temperature of the heat roll is higher than the target temperature, the switch is turned off, and heat generation of the heater is stopped.

In the temperature controller with the above-mentioned arrangement, when the temperature of the heat roll is held at the target temperature, temperature change is very small, and temperature control can be satisfactorily performed. In an initial heating state from an inactive state, the temperature sensor cannot follow the temperature rise of the heat roll, and the temperature detected by the sensor becomes undesirably lower than the actual temperature.

For this reason, when the detected temperature reaches the target temperature, the actual temperature of the heat roll has already exceeded the target temperature. In this manner, when the temperature of the heat roll exceeds the target temperature, the service life of the heat roll or the heater may be shortened, and the temperature over-rise prevention device may be erroneously operated.

SUMMARY OF THE INVENTION

It is an object of the present invention to provide a temperature controller, which can optimally control the temperature of an object to be heated without causing over-rise of the temperature even when a heating operation of the object to be heated is started from an initial state.

According to the present invention, there is provided a temperature controller for, in an initial heating state of an object to be heated, controlling the drive operation of a heating member on the basis of the relationship between a detected temperature (Tx) and a predetermined standby control temperature (TA) from when the detected temperature detected by a temperature sensor reaches the standby control temperature lower than a target temperature (TC) until a predetermined standby control period (t1) elapses, and after an elapse of the standby control period, controlling the drive operation of the heating member on the basis of the relationship between the detected temperature and the target temperature.

According to the present invention, in an initial heating state of an object to be heated, it is expected that the actual temperature of the object to be heated is higher than a detected temperature due to a detection error of the temperature sensor. Thus, the drive operation of the heating member is controlled on the basis of the relationship between a predetermined standby control temperature lower than a target temperature and the detected temperature from when the detected temperature detected by the temperature sensor reaches the standby control temperature lower than the target temperature until a predetermined standby control period elapses. Thus, the over-rise of the temperature due to the detection error of the temperature sensor can be prevented, and the actual temperature of the object to be heated follows the detected temperature obtained by the temperature sensor. After the standby control, the drive operation of the heating member is controlled based on the relationship between the detected temperature and the target temperature.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
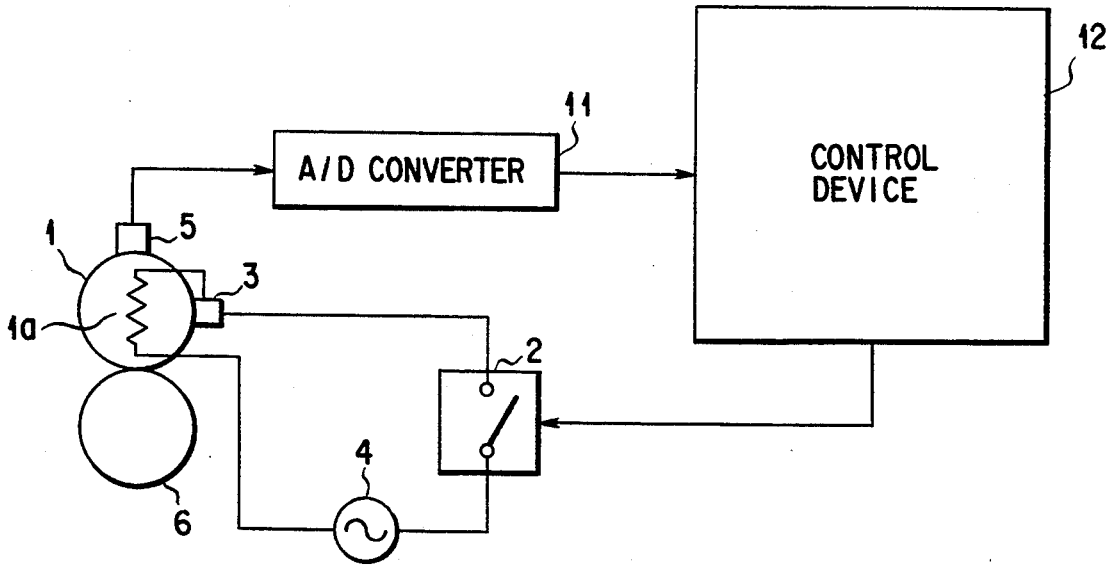
FIG. 1 is a block diagram showing an arrangement of a temperature controller according to an embodiment of the present invention.

Referring to FIG. 1, a heater 1*a* is arranged in a heat roll 1 used in a heat fixing device. The heater 1*a* is connected to a power supply 4 through a temperature over-rise prevention device 3 such as a fuse or a thermostat. A temperature sensor 5 detects the temperature of the heat roll 1, and supplies a voltage according to the detected temperature to a control device 12 through an A/D converter 11.

The A/D converter 11 converts an output signal (analog signal) from the temperature sensor 5 into a digital signal. The control device 12 monitors the output signal from the A/D converter 11, and performs ON/OFF control of a switch 2. The control device 12 comprises, e.g., a microcomputer.

Figure 4:
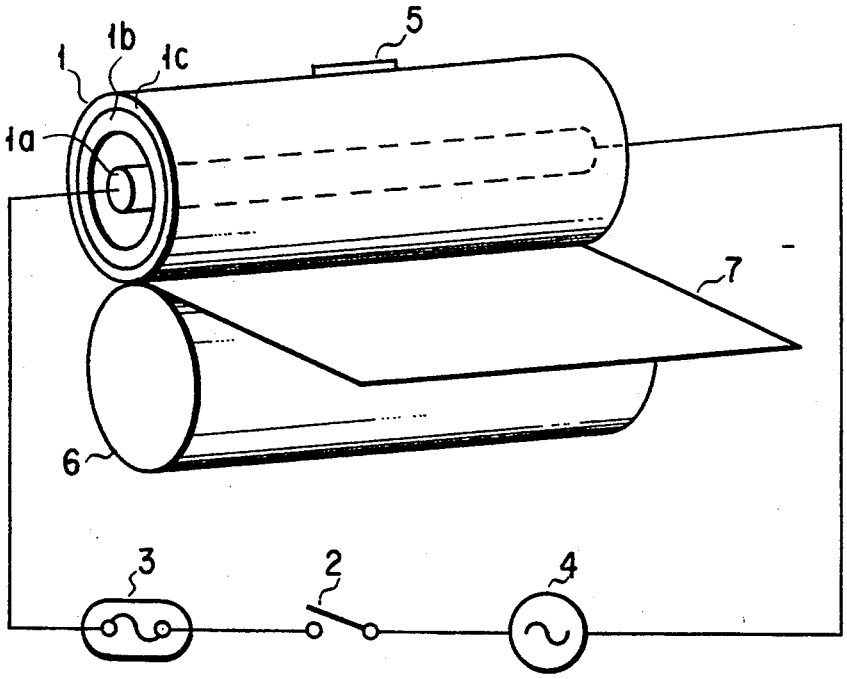
FIG. 4 is a perspective view of a fixing device which adopts a temperature controller of the present invention.

The heat roll 1 of the heat fixing device to which the temperature controller with the above arrangement is attached is constituted by a metal roll 1*b* coated by a fluorine resin layer 1*c*, as shown in FIG. 4. The heat roll 1 is in contact with a pressure roller 6 consisting of silicon rubber. The temperature sensor 5 is in contact with the surface of the fluorine resin layer 1*c* on the roll 1*b*, and slides along the surface of the fluorine resin layer 1*c* upon rotation of the heat roll 1. The heater 1*a* comprises a halogen lamp coaxially arranged in the heat roll 1. The halogen lamp 1*a* is connected to the power supply 4 through the switch 2 and the fuse 3. When the switch 2 is turned on, the halogen lamp 1*a* is turned on by the power supply 4, and heat generated by the halogen lamp 1*a* is conducted to the heat roll 1, thereby fixing a toner image on a paper sheet 7, which passes between the heat roll 1 and the pressure roller 6.

Figure 2:
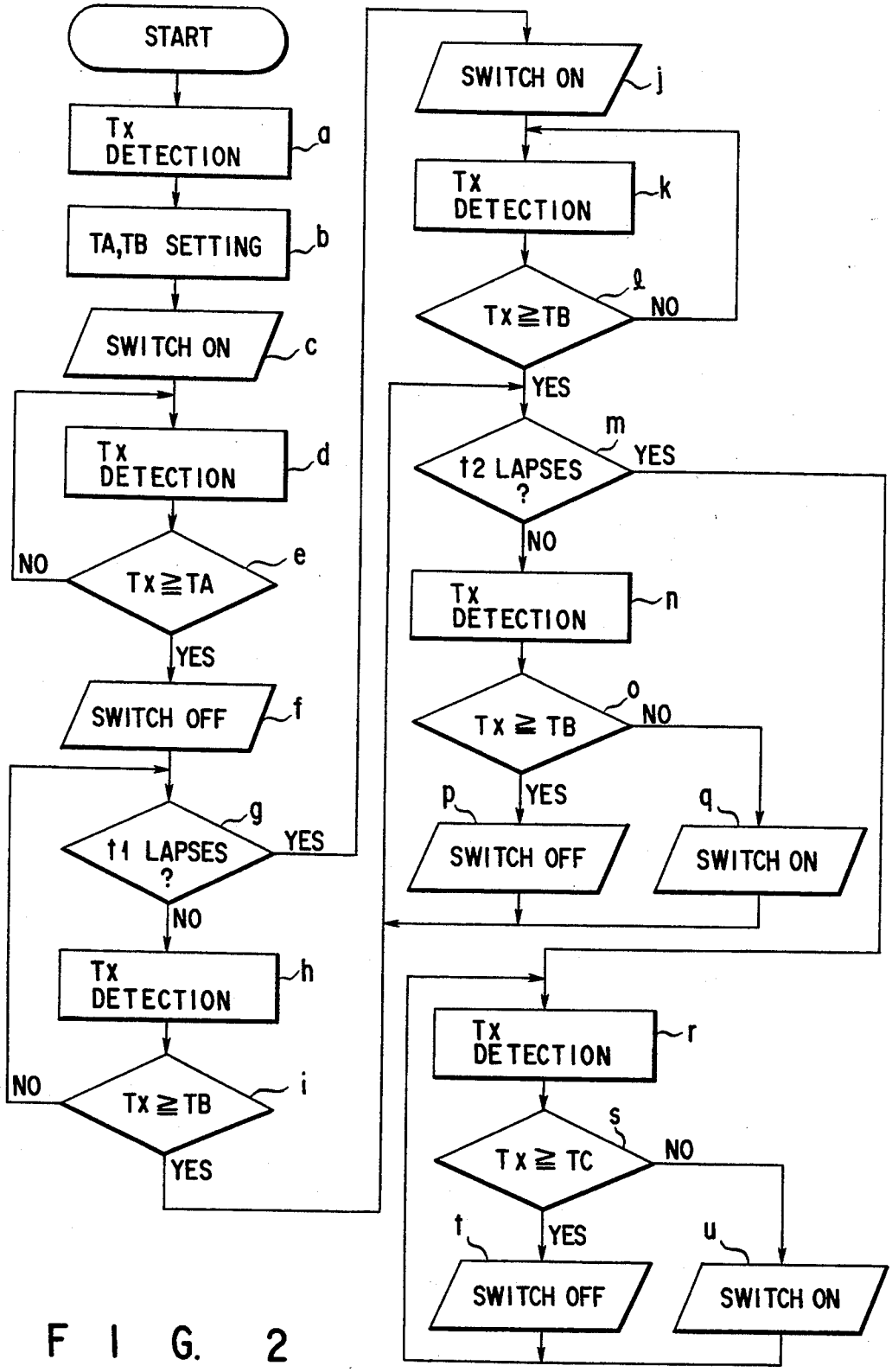
FIG. 2 is a flow chart showing a control sequence of a control device shown in FIG. 1.

The operation of the temperature controller of this embodiment with the above arrangement will be described below with reference to FIG. 2 along the control sequence of the control device 12.

Upon reception of a temperature rise instruction of the heat roll 1 from an external apparatus when the power supply 4 is turned on, the control device 12 recognizes a detected temperature Tx on the basis of an output signal from the A/D converter 11 (the detection signal from the temperature sensor 5). In a step b, the control device 12 reads out a heating interruption temperature TA and a standby control temperature TB according to the detected temperature Tx from a table stored in the control device in step b. The heating interruption temperature TA and the standby control temperature TB are obtained beforehand by, e.g. measurements so as not to cause a difference in error between the actual temperature of the heat roll 1 and the detected temperature according to the initial heating temperature, and are set in the table in the control device 12. For example, the table has the following temperature information.

| Tx | TA | TB | TC |
|---|---|---|---|
| Tx < 10° C. | 160 | 175 | 185 |
| 10° C. ≦ Tx < 165° C. | 165 | 180 | 185 |
| 165° C. ≦ Tx < 180° C. | 165 | 180 | 185 |
| 185° C. ≦ Tx | 185 | 185 | 185 |

A temperature difference (TB−TA) is a temperature almost equal to a temperature rise caused by the thermal time constants of the heat roll 1 and the heater 1*a*, and a temperature difference (TC−TB) is a temperature almost equal to a difference (a detection error of the temperature sensor 5) between the actual temperature of the heat roll 1 and the detected temperature Tx in the initial heating state.

Figure 3:
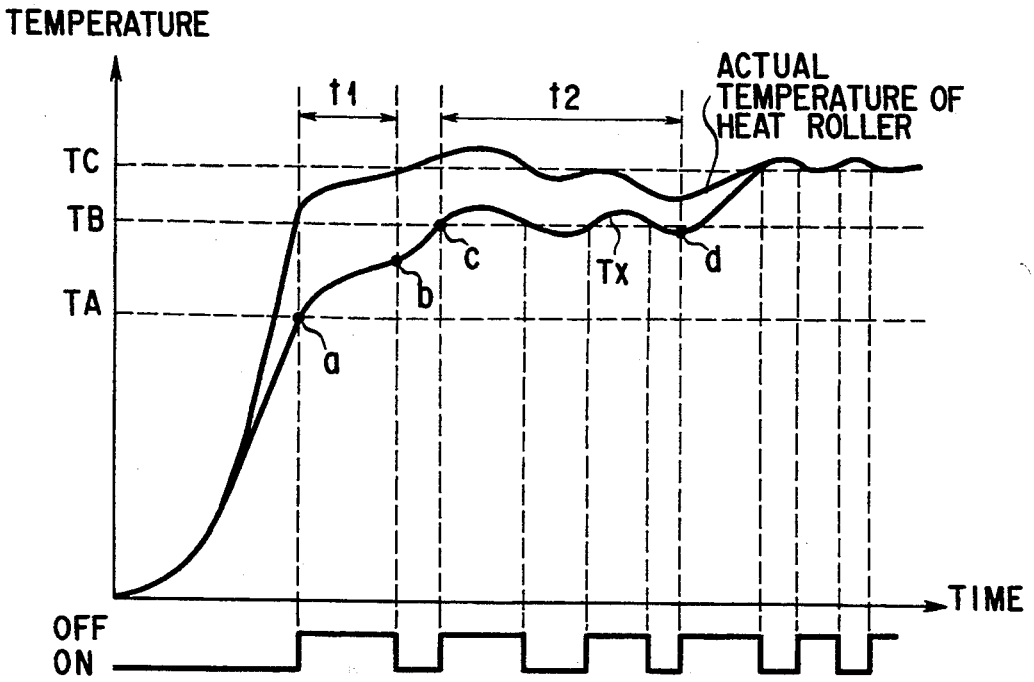
FIG. 3 is a graph showing changes in temperature of a heat roll, and in detected temperature Tx.

In step c, the control device 12 turns on the switch 2 to energize the heater 1*a*. Thus, the temperature of the heat roll 1 is increased, as shown in FIG. 3. In this state, the control device 12 monitors if the detected temperature Tx has reached the heating interruption temperature TA in steps d and e, as shown in FIG. 2. When the detected temperature Tx reaches the heating interruption temperature TA (time a in FIG. 3), the control device 12 advances processing from step e to step f, and turns off the switch 2 to stop energization of the heater 1*a* in step f. However, since the heat roll 1 and the heater 1*a* have thermal time constants, the detected temperature Tx does not decrease immediately, and continues to increase for a while, as shown in FIG. 3. In this state, the control device 12 monitors if a predetermined period t1 (which is set in advance according to the characteristics of the heat roll 1 and the heater 1*a*) has elapsed from when the detected temperature Tx reached the heating interruption temperature TA (time a in FIG. 3), or if the detected temperature Tx has reached the standby control temperature TB in steps g to i, as shown in FIG. 2. After an elapse of the predetermined period t1 (time b in FIG. 3) from when the detected temperature Tx reaches the heating interruption temperature TA (time a in FIG. 3), the control device 12 advances processing from step g to step j, and turns on the switch 2 to restart energization of the heater 1*a* in step j.

In steps k and l, the control device 12 monitors if the detected temperature Tx has reached the standby control temperature TB. When the detected temperature Tx reaches the standby control temperature TB (time c in FIG. 3), the control device 12 advances processing from step 1 to step m. On the other hand, in steps g to i, if the predetermined period t1 has elapsed from when the detected temperature Tx reached the heating interruption temperature TA (time a in FIG. 3), or if the detected temperature Tx has reached the standby control temperature TB, the control device 12 advances processing to step m without executing processing in steps j to l.

In step m, the control device checks if a predetermined period t2 (which is set in advance according to the characteristics of the temperature sensor 5) has elapsed from when the detected temperature Tx reached the standby control temperature TB (time c in FIG. 3). If it is determined that the predetermined period t2 has not elapsed yet, the control device 12 advances processing from step m to step n. In steps n and o, the control device 12 checks if the detected temperature Tx has reached the standby control temperature TB. If it is determined that the detected temperature Tx has reached the standby control temperature TB, the control device 12 turns off the switch 2 to stop energization of the heater 1*a* in step p, and repeats processing starting from step m. If it is determined in step o that the detected temperature has not reached the standby control temperature TB, the control device 12 turns on the switch 2 to start energization of the heater 1*a* in step q, and repeats processing starting from step m. In this manner, constant temperature control is performed with reference to the standby control temperature TB. While the constant temperature control is performed with reference to the standby control temperature TB, the detected temperature Tx detected by the temperature sensor 5 follows the actual temperature of the heat roll 1, thus decreasing an error between the actual temperature of the heat roll 1 and the detected temperature detected by the temperature sensor 5.

When the predetermined period t2 elapses (time d in FIG. 3) from when the detected temperature Tx reaches the standby control temperature TB (time c in FIG. 3) in a state wherein the constant temperature control is performed with reference to the standby control temperature TB, the control device 12 advances processing from step m to step r.

In steps r and s, the control device 12 checks if the detected temperature Tx has reached a target temperature TC. If it is determined that the detected temperature Tx has reached the target temperature TC, the control device 12 turns off the switch 2 to stop energization of the heater 1*a* in step t, and thereafter, repeats processing starting from step r. If it is determined in step s that the detected temperature Tx has not reached the target temperature TC yet, the control device 12 turns on the switch 2 to start energization of the heater 1*a* in step u, and thereafter, repeats processing starting from step r. Thus, constant temperature control is performed with reference to the target temperature TC.

Figure 5:
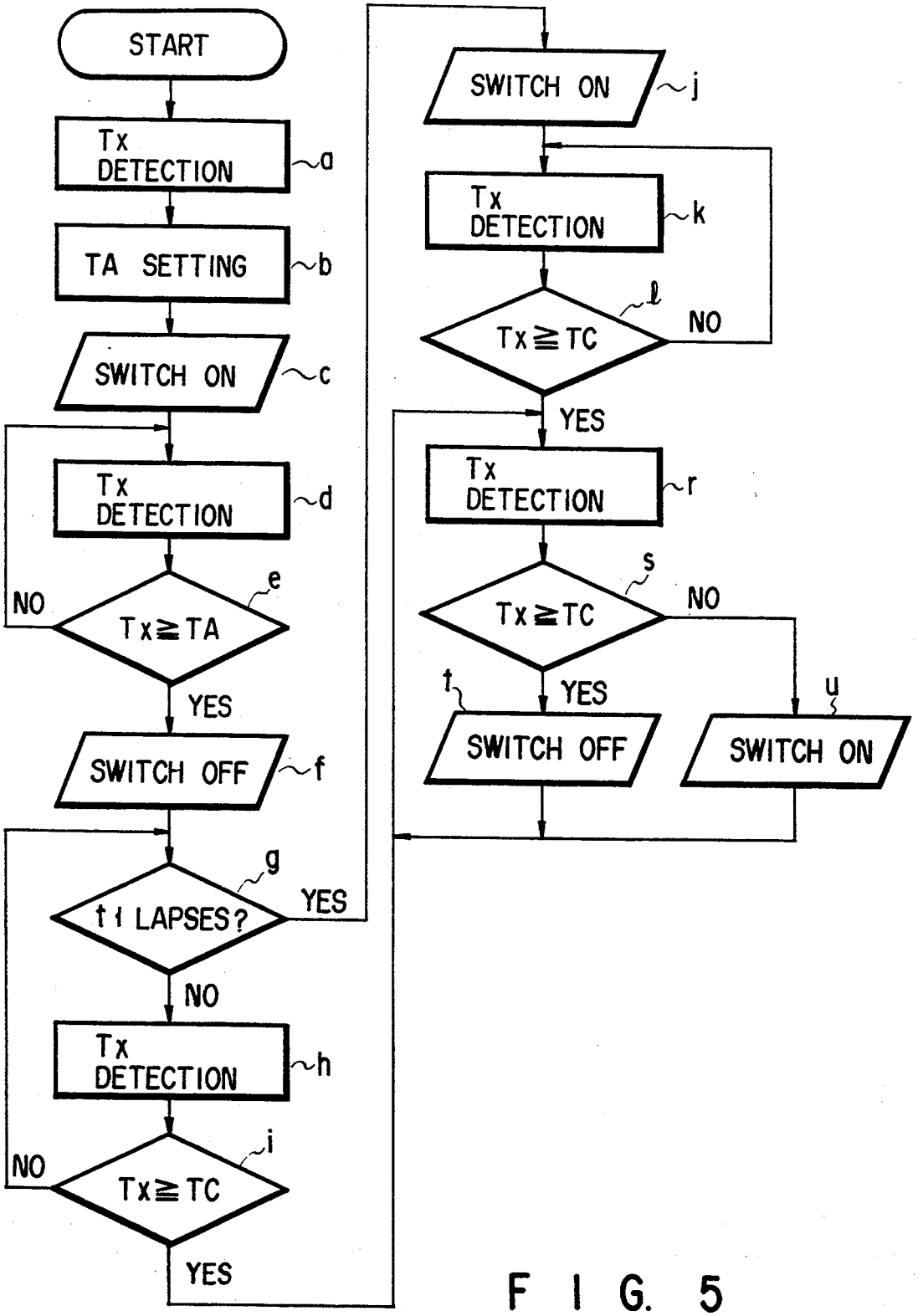
FIG. 5 is a flow chart for explaining an operation of a temperature controller for performing temperature control using a heating interruption temperature and a target temperature.

In this embodiment, a reference temperature for temperature control is switched from the heating interruption temperature TA to the standby control temperature TB, and furthermore, the reference temperature is switched from the standby control temperature TB to the target temperature TC. Alternatively, temperature control may be performed by switching the reference temperature from the heating interruption temperature TA to the target temperature TC without setting the standby control temperature TB. The operation in this case will be described below with reference to the flow chart shown in FIG. 5.

Figure 6:
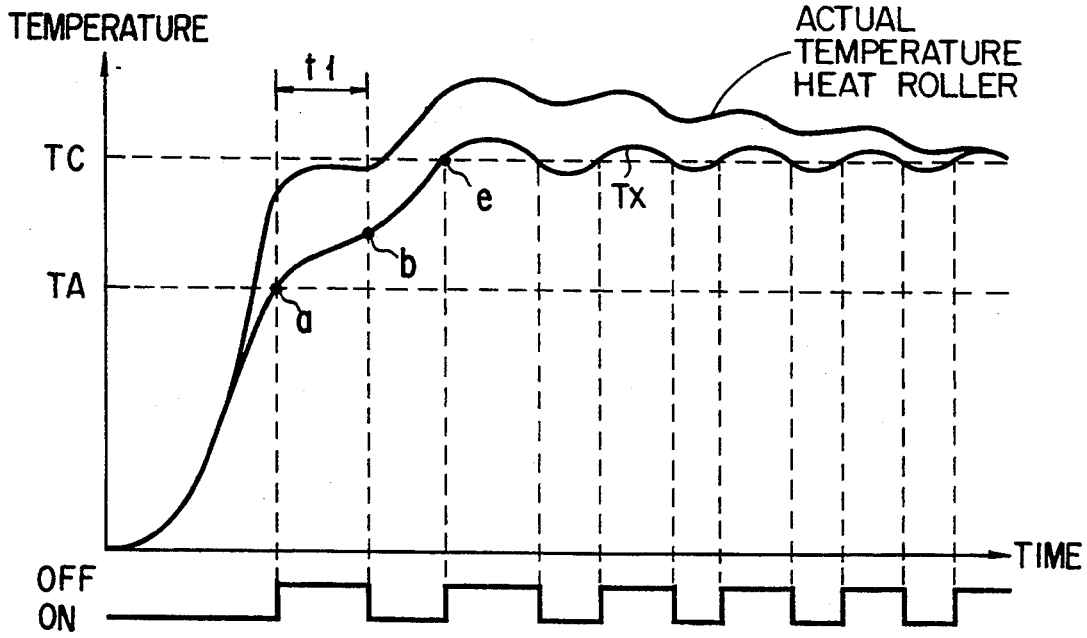
FIG. 6 is a graph showing changes in temperature of a heat roll and in detected temperature according to the embodiment shown in FIG. 5.

After the power supply is turned on, a detected temperature Tx is detected (step a), and a heating interruption temperature TA (e.g., 160° C. or 165° C.) shown in the above table, and corresponding to the detected temperature Tx is set as an initial reference temperature in the control device 12 (step b). In step c, the control device 12 turns on the switch 2. As a result, the heat roll 1 is heated, and the detected temperature Tx is increased, as shown in FIG. 6. In step d, the temperature Tx is detected. In step e, the detected temperature Tx is compared with the heating interruption temperature TA. If it is determined that the detected temperature Tx has reached the heating interruption temperature TA (time a in FIG. 6), the switch 2 is turned off, and the heating operation of the heat roll 1 is interrupted (step f). In step g, it is monitored if a period t1 has elapsed from when the heating operation was stopped. If it is determined that the period t1 has elapsed, the switch 2 is turned on (time b), and the heat roll 1 is heated again (step j). If it is determined that the period t1 has not elapsed yet, the temperature Tx is detected, and it is monitored if the detected temperature Tx has reached the target temperature TC (e.g., 185° C.). If it is determined that the temperature Tx has reached the temperature TC, the flow advances to step r.

If the switch 2 is turned on in step j, steps k and i, i.e., detection of the temperature Tx and comparison between the two temperatures Tx and TC are repeated until the detected temperature Tx reaches the target temperature TC.

If it is determined that the detected temperature Tx has reached the temperature TC (time e), temperature control of the heat roll 1 is performed using the target temperature TC as a reference temperature according to steps r, s, t, and u. More specifically, the temperature control of the heat roll 1 is performed on the basis of the relationship between the detected temperature Tx and the target temperature TC, so that the temperature of the heat roll 1 is maintained at almost the target temperature TC.

Figure 7:
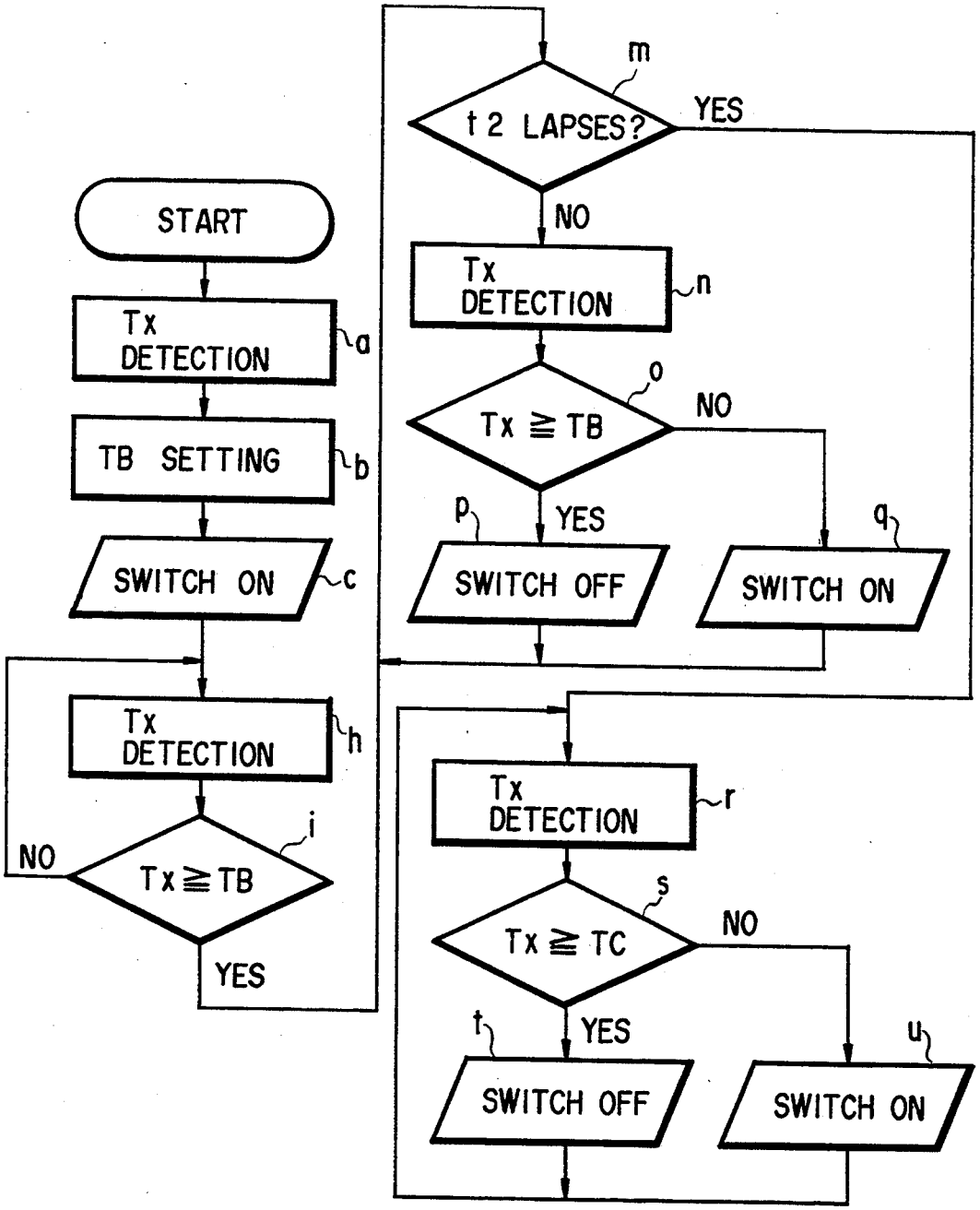
FIG. 7 is a flow chart for explaining an operation of a temperature controller for performing temperature control using a standby control temperature and a target temperature.

In this embodiment, the reference temperature for temperature control is switched from the heating interruption temperature TA to the standby control temperature TB or the target temperature TC. For example, when the thermal time constants of the heat roll 1 and the heater 1*a* are small (i.e., when a temperature rise caused by the thermal time constants of the heat roll 1 and the heater 1*a* is small), the temperature control may be made by switching the reference temperature from the standby control temperature TB to the target temperature TC without setting the heating interruption temperature TA. The operation in this case will be described below with reference to the flow chart shown in FIG. 7.

Figure 8:
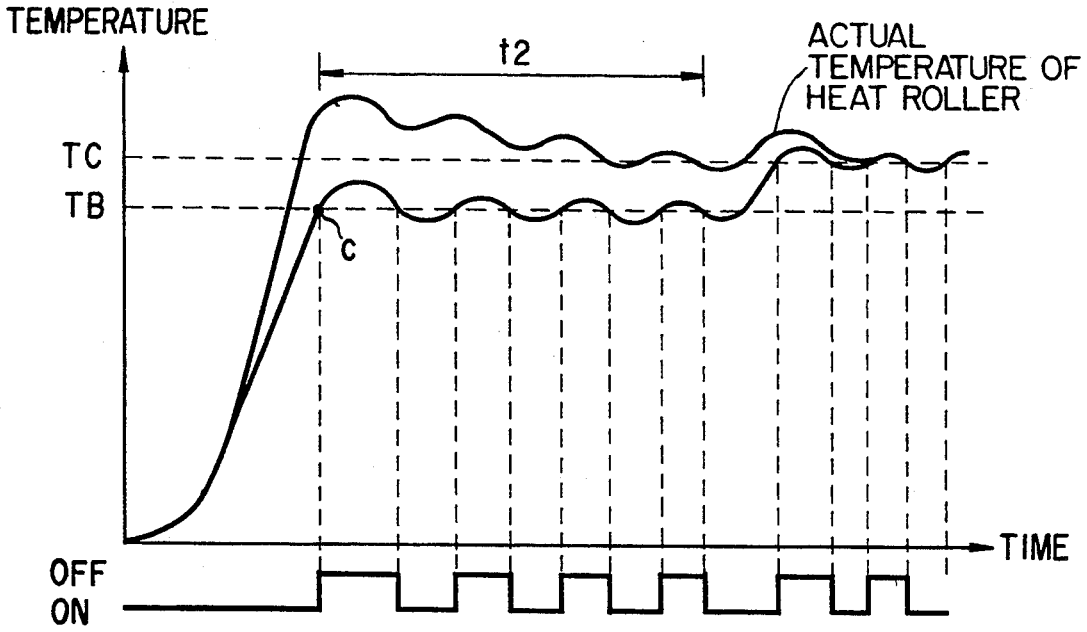
FIG. 8 is a graph showing changes in temperature of a heat roll and in detected temperature according to the embodiment shown in FIG. 7.

After the power supply is turned on, a detected temperature Tx is detected (step a), and a standby control temperature TB (e.g., 175° C. or 180° C.) shown in the above table, and corresponding to the detected temperature Tx is set as an initial reference temperature in the control device 12 (step b). In step c, the control device 12 turns on the switch 2. As a result, the heat roll 1 is heated, and the detected temperature Tx is increased, as shown in FIG. 8. In step h, the temperature Tx is detected. In step i, the detected temperature Tx is compared with the standby control temperature TB. If it is determined that the detected temperature Tx has reached the standby control temperature TB (time c in FIG. 8), it is monitored if a period t2 has elapsed from time c (step m). If it is determined that the period t2 has not elapsed yet, the temperature Tx is detected (step n), and is compared with the standby control temperature TB (step o). At this time, since $Tx \geqq TB$, the control device 12 supplies an OFF signal to the switch 2 to turn it off (step p). Thereafter, it is monitored again whether or not the period t2 has elapsed (step m). The temperature Tx is detected, and is compared with the temperature TB. At this time, if $Tx < TB$, the switch 2 is turned on, and the heat roll 1 is heated again. Such operations, i.e., steps m, n, o, and p or q are repeated until the period t2 elapses.

If it is determined that the period t2 has elapsed, the temperature Tx is detected (step r), and the detected temperature Tx is compared with the target temperature TC (step s). More specifically, the reference temperature for temperature control is switched to the target temperature TC. Therefore, thereafter, the temperature control of the heat roll 1 is performed using the target temperature TC as a reference temperature. That is, the temperature control of the heat roll 1 is performed based on the relationship between the detected temperature Tx and the target temperature TC, so that the temperature of the heat roll 1 is maintained at almost the target temperature TC.

Figure 9:
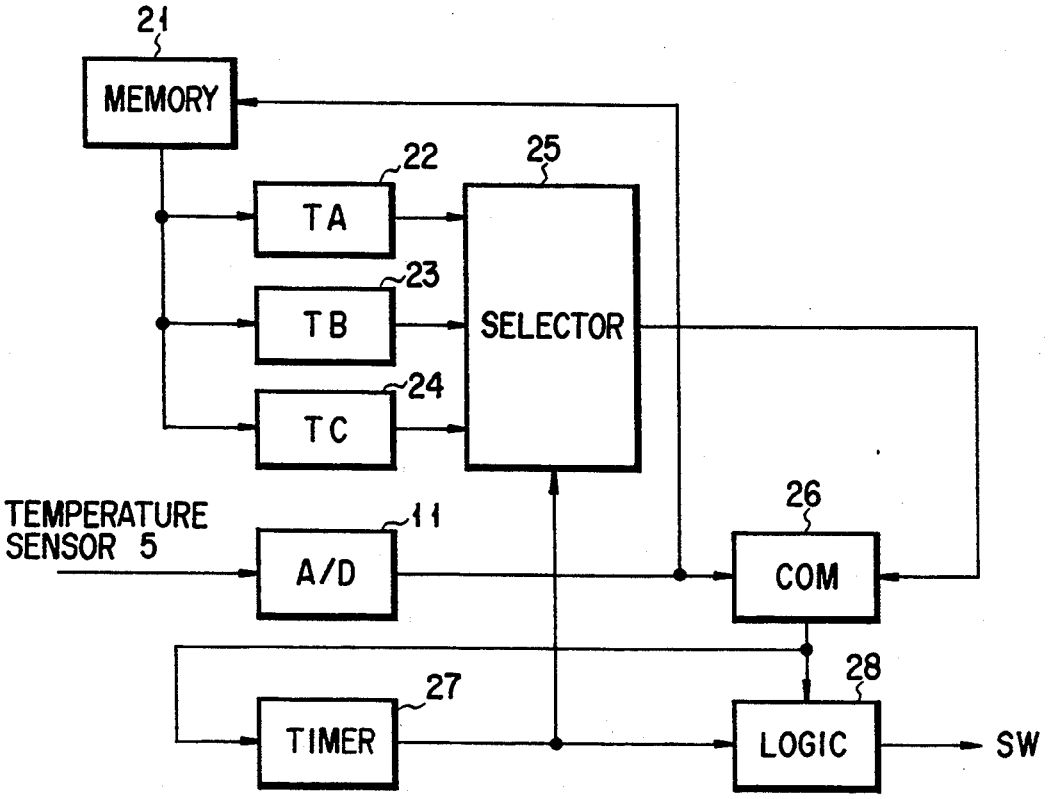
FIG. 9 is a circuit diagram of a temperature controller having a hardware arrangement.

In this embodiment, the temperature control processing is performed in a software manner by a microcomputer, but may be executed by a hardware circuit shown in FIG. 9.

According to this embodiment, a memory 21 stores pieces of temperature information shown in the above table. Temperature data TA, TB, and TC are transferred from the table to buffers 22, 23, and 24 according to a detected temperature Tx. The output terminals of the buffers 22 to 24 are connected to the input terminals of a selector 25 for selecting one of the temperature data TA, TB, and TC. The output terminal of the selector 25 is connected to one input terminal of a comparator 26. The other input terminal of the comparator 26 is connected to the output terminal of an A/D converter 11. More specifically, the comparator 26 is arranged to compare the temperature data TA, TB, and TC with the detected temperature Tx. The output terminal of the comparator 26 is connected to a timer 27 and a logic circuit 28. The timer 27 is arranged to measure the periods t1 and t2. The logic circuit 28 outputs one of the comparison result from the comparator 26 and timer data from the timer 27 to the switch 2 as ON/OFF data.

According to the temperature controller shown in FIG. 9, the memory 21 is addressed based on the detected temperature Tx, and temperature data corresponding to the detected temperature Tx are respectively read out to the buffers 22 to 24. At this time, the selector 25 selects the temperature data TA, and supplies it to the comparator 26. The comparator 26 compares the temperatures Tx and TA, and if $Tx \geqq TA$, it outputs an output signal to the timer 27 and the logic circuit 28. At this time, the logic circuit 28 supplies the output signal from the comparator 26 to the switch 2 as an OFF signal, thus turning off the switch 2. The timer 27 is operated in response to the output signal from the comparator 26. When the timer 27 counts the period t1, it sends an output signal to the selector 25 and the logic circuit 28. At this time, the selector 25 selects the temperature data TB, and supplies it to the comparator 26. Therefore, the comparator 26 compares the detected temperature Tx and the standby control temperature TB. If $Tx \geqq TB$, the output signal from the comparator 26 turns off the switch 2 as an OFF signal through the logic circuit 28. At this time, the timer 27 counts the period t2. The comparator 26 supplies ON and OFF signals to the switch 2 through the logic circuit 28 until the period t2 elapses after $Tx \geqq TB$ is established, thus turning on/off the switch 2. More specifically, the temperature control of the heat roll 1 is performed on the basis of the standby control temperature TB.

When the period t2 elapses, the selector 25 selects the temperature data TC according to the output signal from the timer 27, and supplies it to the comparator 26. More specifically, the temperature controller performs temperature control of the heat roll 1 on the basis of the target temperature TC.

According to this embodiment, as described above, the detected temperature Tx is caused to follow the actual temperature of the heat roll 1 by constant temperature control with reference to the standby control temperature TB, which is performed for a period t2 from when the detected temperature Tx reaches the standby control temperature TB. Thereafter, constant temperature control with reference to the target temperature TC is started. For this reason, the temperature of the heat roll 1 can be prevented from being excessively increased due to the detection error of the temperature sensor 5. In this embodiment, since the heating operation is temporarily stopped at the heating interruption temperature TA lower than the standby control temperature TB, the temperature of the heat roll 1 can also be prevented from being excessively increased due to a temperature rise caused by the thermal time constants of the heat roll 1 and the heater 1*a*.

In this manner, the temperature of the heat roll 1 can be accurately controlled to be the target temperature TC without causing temperature over-rise.

In this embodiment, the heating interruption temperature TA and the standby control temperature TB are changed and set according to the initial heating temperature. However, the heating interruption temperature TA and the standby control temperature TB may be fixed values.

The above embodiment has exemplified the temperature controller for performing temperature control of a heat fixing device. However, the temperature controller of the present invention can be applied to any other heat generating devices, whose heat generating temperature must be controlled to be a constant temperature.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A temperature controller for controlling a temperature of an object heated by heating means, comprising:

temperature detection means for detecting the temperature of the heated object;

temperature control means for controlling, from an initial temperature state of the heated object, the drive operation of said heating means;

said temperature control means deenergizing said heating means to interrupt the drive heating operation of said heating means and thereby slow down the rate of rise of the object temperature for a predetermined control period of time beginning when the temperature detected by said temperature detection means reaches a first control temperature lower than a target temperature; and means for controlling the drive operation of said heating means according to a relationship between a second control temperature, corresponding to the target temperature, and the detected temperature after the predetermined control period of time elapses.

2. A controller according to claim 1, wherein the object to be heated has a heat roll used in a fixing device provided for an electrophotographic recording apparatus, and said temperature detection means includes a temperature sensor attached to said heat roll.

3. A controller according to claim 1, wherein said temperature detection means includes means for converting the detected temperature detected by said temperature sensor into digital data.

4. A controller according to claim 1, wherein said heating means includes a heating member, and means, controlled by said temperature control means, for turning on/off power supply to said heating member.

5. A controller according to claim 1, wherein said temperature control means includes means for storing temperature data, which represent a plurality of first and second control temperatures set in correspondence with the detected temperature, and are read out according to the detected temperature from said temperature detection means.

6. A temperature controller for controlling a temperature of an object heated by heating means, to a predetermined target temperature, comprising:

temperature detection means for detecting the temperature of the heated object;

temperature control means for controlling, from an initial temperature state of the heated object, the drive operation of said heating means;

said temperature control means including first control means for controlling, in an initial temperature rising state of the heated object, the drive operation of said heating means according to a relationship between the temperature detected by said temperature detection means and a predetermined standby control temperature lower than the target temperature; said first control means deenergizing said heating means for a predetermined standby control period of time beginning when the detected temperature reaches the standby control temperature; and said temperature control means further including second control means for controlling the drive operation of said heating means according to a relationship between the detected temperature and the target temperature after the standby control period elapses whereby the rate of rise of the object temperature is slowed down to avoid temperature overshoot.

7. A controller according to claim 6, further comprising:

said temperature control means including heating stop means for forcibly stopping operation of said heating means when the detected temperature reaches the standby control temperature; and third control means for causing said first control means to control said heating means when the detected temperature reaches the standby control temperature after the heating operation is stopped by said heating stop means, or after an elapse of a predetermined heating interruption period from when the operation of said heating means is stopped by said heating stop means.

8. A controller according to claim 6, wherein the object to be heated comprises a heat roll used in a fixing device provided for an electrophotographic recording apparatus, and said temperature detection means includes a temperature sensor attached to said heat roll.

9. A controller according to claim 8, wherein said temperature detection means includes means for converting the detected temperature detected by said temperature sensor into digital data.

10. A controller according to claim 6, wherein said heating means includes a heating member, and means, controlled by said first control means, for turning on/-off power supply to said heating member.

11. A controller according to claim 6, wherein said heating means includes a heating member, and means, controlled by said second control means, for turning on/off power supply to said heating member.

12. A controller according to claim 6, wherein said first control means includes means for storing standby control temperature data, which represent a plurality of standby control temperatures set in correspondence with the detected temperature, and are read out according to the detected temperature obtained by said temperature detection means.

13. A temperature controller for controlling a temperature of an object heated by heating means, comprising:

temperature detection means for detecting the temperature of the heated object;

temperature control means for controlling, from an initial temperature state of the heated object, the drive operation of said heating means;

said temperature control means deenergizing said heating means to interrupt the drive heating operation of said heating means during a first control period of time beginning when the temperature detected by said temperature detection means reaches a first control temperature lower than a target temperature;

said temperature control means further controlling the drive operation of said heating means according to a relationship between a second control temperature, lower than the target temperature and higher than the first control temperature, and the detected temperature during a second control period of time after the first control period of time has elapsed to slow down the rate of rise of the object temperature; and said temperature control means controlling the drive operation of said heating means in accordance with a relationship between the target temperature and the detected temperature after the second control period of time elapses.

14. A controller according to claim 13, wherein the object to be heated is a heat roll used in a fixing device provided for an electrophotographic recording apparatus, and said temperature detection means includes a temperature sensor attached to said heat roll.

15. A controller according to claim 13, wherein said temperature detection means includes means for converting the detected temperature detected by said temperature sensor into digital data.

16. A controller according to claim 13, wherein said heating means includes a heating member, and means, controlled by said temperature control means, for turning on/off power supply to said heating member.

17. A controller according to claim 13, wherein said temperature control means includes means for storing temperature data, which represent a plurality of first and second control temperatures set in correspondence with the detected temperature, and are read out according to the detected temperature from said temperature detection means.

18. A fixing device for fixing a developed image, comprising:

a heat roll constituted by heating means, and roll means heated by said heating means;

temperature detection means for detecting a temperature of said heating roll;

temperature control means for controlling, from an initial temperature state of the heat roll, the drive operation of said heating means;

said temperature control means controlling a drive operation of said heating means in accordance with a relationship between a first control temperature lower than a target temperature and the detected heat roll temperature, said control means deenergizing said heating means for a predetermined standby control period of time beginning when the detected heat roll temperature reaches the first control temperature; and said temperature control means controlling the drive operation of said heating means according to a relationship between a second control temperature corresponding to the target temperature, and the detected heat roll temperature after the predetermined standby control period of time elapses.

19. A device according to claim 18, wherein said temperature detection means includes a temperature sensor attached to said heat roll.

* * * * *

UNITED STATES PATENT AND TRADEMARK OFFICE

CERTIFICATE OF CORRECTION

PATENT NO. : 5,412,453

DATED : May 02, 1995

INVENTOR(S) : Tetsushi MATSUO

It is certified that error appears in the above-indentified patent and that said Letters Patent is hereby corrected as shown below:

Claim 18, Column 10, Line 68, change "heating" to --heat--.

Signed and Sealed this

Fifth Day of December, 1995

*Attest:*

*Attesting Officer*

Bruce Lehman

BRUCE LEHMAN

*Commissioner of Patents and Trademarks*